US006659367B2

(12) United States Patent
Ballu

(10) Patent No.: US 6,659,367 B2
(45) Date of Patent: Dec. 9, 2003

(54) SPRAYER DEVICE FOR SPRAYING A LIQUID COATING PRODUCT

(75) Inventor: Patrick Ballu, Reims (FR)

(73) Assignee: Sames Technologies, Meylan (FR)

( * ) Notice: Subject to any disclaimer, the term of this patent is extended or adjusted under 35 U.S.C. 154(b) by 0 days.

(21) Appl. No.: 10/166,308

(22) Filed: Jun. 11, 2002

(65) Prior Publication Data

US 2003/0164406 A1 Sep. 4, 2003

(30) Foreign Application Priority Data

Mar. 1, 2002 (FR) ..... 02 02638

(51) Int. Cl.[7] ..... F23D 11/04

(52) U.S. Cl. ..... 239/223; 239/224; 239/690; 239/703

(58) Field of Search ..... 239/223, 224, 239/222.11, 222.13, 222.15, 690, 700, 703, 708, 112

(56) References Cited

U.S. PATENT DOCUMENTS

| | | | | | |
|---|---|---|---|---|---|
| 692,631 | A | * | 2/1902 | Cooley | 425/71 |
| 2,658,472 | A | | 11/1953 | Ransburg | |
| 3,983,694 | A | * | 10/1976 | Bracken, Jr. | 60/745 |
| 4,838,487 | A | * | 6/1989 | Schneider | 239/223 |
| 5,582,347 | A | * | 12/1996 | Knobbe et al. | 239/3 |
| 5,707,009 | A | * | 1/1998 | Schneider | 239/112 |
| 5,934,574 | A | * | 8/1999 | van der Steur | 239/690.1 |
| 6,050,499 | A | * | 4/2000 | Takayama et al. | 239/112 |
| 6,105,886 | A | | 8/2000 | Hollstein et al. | |
| 6,189,804 | B1 | * | 2/2001 | Vetter et al. | 239/7 |

FOREIGN PATENT DOCUMENTS

| | | | | |
|---|---|---|---|---|
| DE | 31 05 186 | A | 9/1982 | |
| DE | 92 17 458.2 | U1 | 1/1994 | |
| EP | 0 094 796 | A | 11/1983 | |
| EP | 0 818 243 | A | 1/1998 | |
| EP | 0951942 | A2 * | 3/1999 | B05B/5/04 |
| EP | 0 951 942 | A2 | 10/1999 | |
| FR | 2762237 | | 10/1998 | |
| FR | 2 805 182 | | 8/2001 | |
| GB | 1 464 042 | | 2/1977 | |

* cited by examiner

*Primary Examiner*—Gregory L. Huson
*Assistant Examiner*—Amanda Flynn
(74) *Attorney, Agent, or Firm*—Young & Thompson

(57) ABSTRACT

A device for spraying a liquid coating product includes a hub forming or accommodating a liquid feed pipe and a divergent centrifugal deflector having a distribution surface whose overall shape is that of a trumpet bell. Applications include electrostatic painting.

22 Claims, 1 Drawing Sheet

11
12
13
14
15
17
18
19
20
22
24
26
28
30
32
34
36
40
44
50
II
III
IV
x
x'

14
18
28
30
32
36
38
39
40
42
44
46
50

26
30
32
36

18
22
28
32
40
44
I

SPRAYER DEVICE FOR SPRAYING A LIQUID COATING PRODUCT

BACKGROUND OF THE INVENTION

1. Field of the Invention

The invention relates to a sprayer device, usually called a sprayer bowl, for spraying a liquid coating product in the form of fine droplets; it applies to spraying any type of liquid paint or varnish, for example. The invention also relates to any rotary head sprayer equipped with this kind of sprayer device. The invention is preferably applied to a sprayer with a very high rotation speed, typically of the order of 50,000 to 100,000 revolutions per minute.

2. Description of the Prior Art

Many types of coating product sprayer device in the form of bowls or bells rotating at high speed are known to the person skilled in the art. The product to be sprayed flows over the interior surface of the bowl and, due to the effect of centrifugal force, reaches the rim of the bowl from which it is sprayed in the form of fine droplets. The bowl is usually shaped so that the surface facing the object to be coated is globally concave, often frustoconical. For example, the document EP 0951942 describes a bowl which has a frustoconical distribution surface.

The document U.S. Pat. No. 6,926,31 describes an externally charged rotary electrostatic device for dispersing a liquid in the form of threads that form textile fibers as the liquid solidifies in the air through dispersion and evaporation of its more volatile constituents. The fibers are formed beyond the rotary device because the liquid is subjected to an electric field created between two electrodes situated downstream of the rotary device. The document U.S. Pat. No. 6,926,31 does not relate to electrostatic spraying of liquid coating products. Moreover, the rotation speed is insufficient to spray the liquid due to the effect of centrifugal force alone. The liquid is in the form of a thin layer when it enters the area in which the electric field is present.

The person skilled in the art knows that to obtain a fine and regular spray, the regularity with which the liquid spreads over the distribution surface up to the spraying edge is of particular importance. In particular, the volume of air entrained in rotation in the interior of the bowl can generate friction on the liquid film that spreads over the distribution surface, which has a favorable influence on spreading and spraying quality. However, nothing must interfere with imparting rotation to this volume of air, which is confined to the interior of the cavity of the bowl.

U.S. Pat. No. 2,658,472 describes a sprayer bell with liquid ejector nozzles inside it directed toward the distribution surface. The presence of these nozzles interferes with entraining in rotation the volume of air in the interior of the sprayer bell. Moreover, the nozzles deposit the liquid at a very short distance from the sprayer edge, which does not favor correct spreading of the liquid over said distribution surface before it is sprayed from the edge of the bell.

The invention proposes a rotary sprayer device having a combination of features that operate in conjunction to obtain a very fine spray, with an extremely close distribution of the diameter of the droplets, producing an improved appearance of the deposit, in particular in the case of a paint.

SUMMARY OF THE INVENTION

To be more precise, the invention provides a liquid coating product sprayer device including a tubular hub forming or accommodating a liquid feed pipe, a divergent centrifugal deflector adapted to be driven in rotation about a rotation axis and having a sprayer edge and a continuous distribution surface which has the overall shape of a trumpet bell and extends between the hub and the sprayer edge, and means for deflecting at least a portion of the liquid in a substantially radial direction toward an innermost portion of the trumpet bell shaped distribution surface.

It may be considered that this kind of distribution surface, combined with the fact that the cavity of the bowl is free of injectors because the liquid is deposited at the back of the bell, optimizes the action of the air rotating in the cavity of the bowl on the film of liquid that flows over the distribution surface. This achieves significant thinning of the layer of liquid (typically paint) on said distribution surface as it moves toward the sprayer edge, and a regular thickness of this layer. The thinning of the layer as it moves toward the sprayer edge can also be attributed to a considerable increase in the surface area of the basic distribution ring, in the direction perpendicular to the rotation axis, by reason of the "trumpet" shape of the distribution surface, this increase in surface area being combined with the increase in the centrifugal speed of the liquid, related to the distance from the axis.

Note further that the trumpet shape of this surface favors good cleaning with the aid of a liquid cleaning product injected instead of the liquid to be sprayed. To be more precise, this surface has no discontinuity that can cause undesirable accumulation of certain constituents of the liquid to be sprayed, in particular certain pigments.

As the person skilled in the art knows, the sprayer edge can be a sharp edge or notched. Striations can be imprinted in this surface in the vicinity of the sprayer edge or disposed on the distribution surface.

In one embodiment, the profile of the distribution surface in half-section taken along the rotation axis of said rotary bowl is substantially exponential. This profile can also have the shape of a curve represented by a function with a fast rate of increase, such as $y=x^2$ or $y=x^n$, or any linear combination of functions of this type, or of the type $y=a^x$, of which the exponential function is one particular instance. By "function with a fast rate of increase" is meant any function whose derivative increases with the variable. A hyperbolic section can also be adopted as the profile. Any linear combination of the above types of curves is equally suitable.

As a general rule, any rotary sprayer bowl combining a central feed (i.e. axial injection of liquid into the hub) with a distribution surface of the type described above falls within the scope of the invention.

According to another advantageous feature, the sprayer device further includes a distributor mounted in axial alignment with the hub, and extending as far as the back of the deflector, the distributor including a core forming an obstacle to the axial flow of the liquid and radial passages disposed to the rear of the core to direct at least the greater portion of the liquid flow toward the distribution surface.

The invention will be better understood and other advantages of the invention will become apparent in the light of the following description of one embodiment of a liquid coating product sprayer device, which description is given by way of example only and with reference to the accompanying drawing.

DETAILED DESCRIPTION OF THE PREFERRED EMBODIMENT

Figure 1:
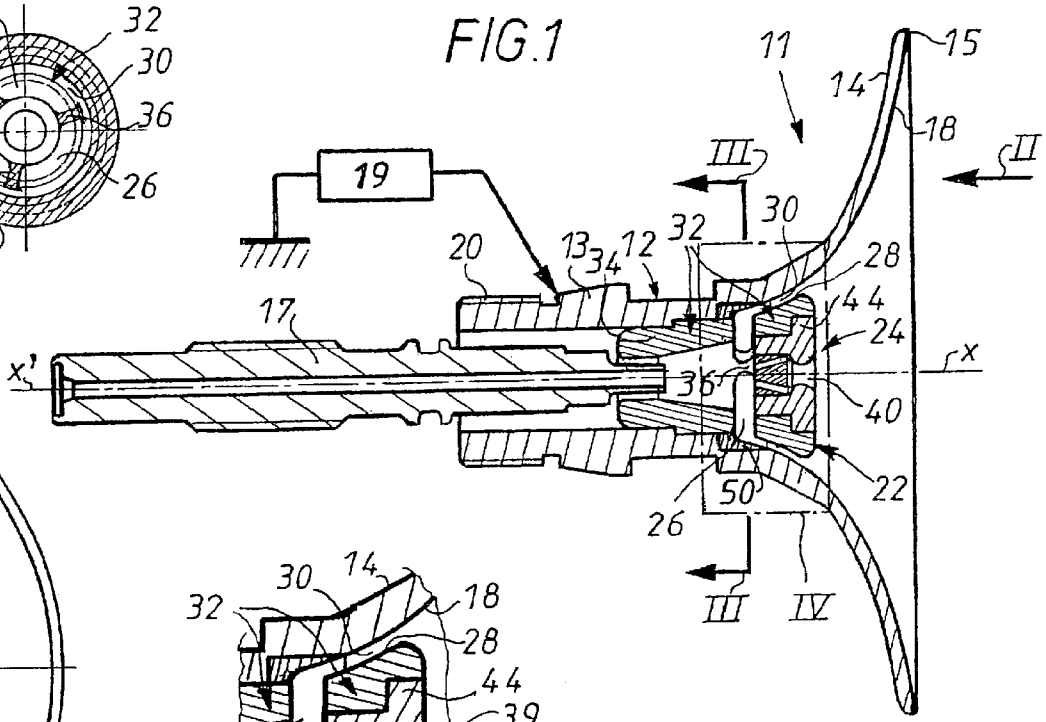
FIG. 1 is a view of a sprayer bowl in axial section taken along the line I—I in FIG. 2.
Figure 4:
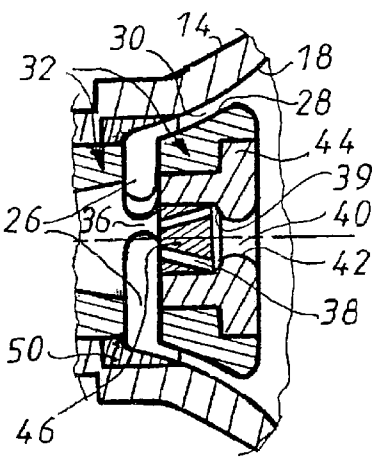
FIG. 4 is an enlarged view of the portion IV of FIG. 1.
Figure 3:
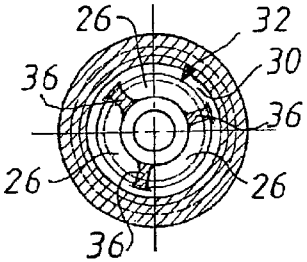
FIG. 3 is a section taken along the line III—III in FIG. 1.
Figure 2:
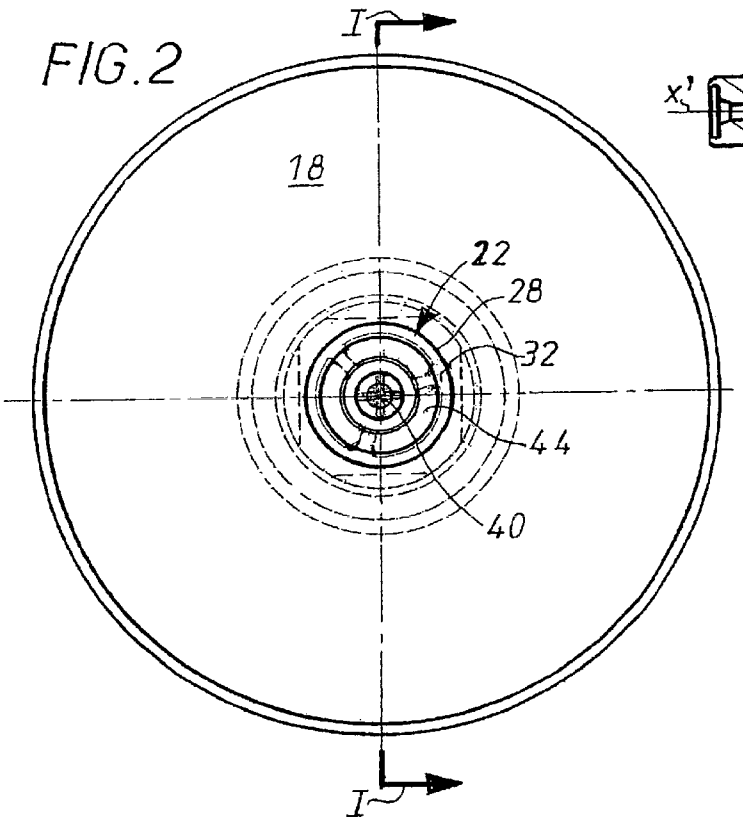
FIG. 2 is a view in the direction of the arrow II in FIG. 1.

The drawing shows a liquid sprayer device 11 comprising a circular member 12 adapted to be driven in rotation and at a relatively high speed about a main axis xx'. The device is particularly suitable for electrostatically spraying liquid coating products such as paint or varnish. The circular member 12 essentially comprises a tubular axial hub 13 extended toward the front by a divergent centrifugal deflector 14 having a circular sprayer edge 15. The hub 13 constitutes or accommodates a liquid feed pipe. The liquid to be sprayed propagates in the forward direction until it reaches a continuous distribution surface 18 extending between the hub and the sprayer edge. The hub 13 is mounted at the end of a hollow shaft of a drive device, not shown. The drive device is conventionally a compressed air turbine. In the example described, the liquid to be sprayed is introduced via an injector 17 in the hollow shaft of the turbine and in the hub. It flows in the forward direction, spreading over said distribution surface 18. Said hub 13 includes a screwthread 20 by means of which it can be fixed to the shaft of the turbine. As an alternative to this, it can be fixed magnetically, as described in the document FR 2805182.

Said distribution surface 18 has the overall shape of a trumpet bell, and the liquid leaving the hub 13, to be more precise the injector 17, is distributed in a thin film over the distribution surface, moving forward to the sprayer edge, at which it is sprayed in the form of fine droplets, due to the effect of centrifugal force. In the case of an electrostatic sprayer device, the centrifugal deflector 14 is made at least in part from an electrically conductive material. It is generally at a high negative electrical potential, of around 100 kV, and the object to be painted is grounded.

FIG. 1 shows diagrammatically a high voltage source 19 electrically connected to the deflector 14. The latter can be made of metal, for example, or covered internally with an electrically conductive layer.

The action of the high electric field in the vicinity of the sprayer edge 15 contributes to breaking the thin film up into fine droplets, exactly like the effect of the centrifugal force. Because of its large radius of curvature, a continuous profile of the centrifugal divergent deflector, such as that of a trumpet shape, concentrates the electric field in the area having the smallest radius of curvature, i.e. the sprayer edge, precisely where the droplets are formed by an essentially mechanical action. The trumpet shape is therefore favorable to all of the means that contribute to proper spraying of the liquid at the sprayer edge, i.e. a mechanical effect and an electrostatic effect.

The global shape of the distribution surface 18 is that of a trumpet bell. In other words, said distribution surface facing toward the object to be covered is globally convex. The distribution surface typically has an exponential shape in half-section taken along the rotation axis.

The circular member 12 comprising the hub and the centrifugal deflector accommodates means for deflecting a portion of the liquid in a substantially radial direction toward the innermost portion of the distribution surface 18. In this example, this is a distributor 22 axially aligned with the hub 13 and extending in part to the back of the deflector 14. The function of this distributor is to deflect the liquid introduced axially so that the greater part of the flow of liquid is directed toward the innermost area of the distribution surface 18. The distributor 22 has a core 24 providing an obstacle to axial flow of the liquid. It has radial passages 26 to the rear of the core. The core 24 has a circular lateral surface 28 facing and at a distance from the innermost area of the distribution surface 18, to define with said surface an annular passage 30 extending from said radial passages. In particular, the distributor 22 includes a tubular circular member 32 which has a rear mounting portion 34 fixed to the interior of the axial hub 13. The injector 17 terminates at a nozzle inserted into the axial cavity of the mounting portion 34, facing the rear face of the core 24. The radial passages 26 are formed by three cut-outs in the member 32 between said mounting portion and the core 24. In fact, these three cut-outs leave of the member 32 only three bridges 36 offset circumferentially at 1200 to each other and linking said mounting portion 34 to the core 24. Accordingly, the greater portion of the liquid injected axially through the hub 13 passes through the member 32 until it impinges on the rear face of the core 24 and continues to flow radially as far as the distribution surface 18, over which it spreads as it travels in the forward direction as far as the sprayer edge 15.

Moreover, the most central portion of the deflector is lined internally with an annular wear member 50 integrated with the innermost portion of the distribution surface 18. In particular, the visible interior surface of the annular member espouses and extends the distribution surface 18 with no break in continuity. It is globally radially outside and facing the radial passages 26. The annular wear member can be nested in the back of the deflector. In this case, it is designed to be replaced regularly. As an alternative to this, the annular member can be made from a material that is highly resistant to abrasion (ceramic, hard metal, etc.), or at least its internal surface, facing the radial passages 26, can be covered with a material resistant to abrasion, for example titanium nitride. Another alternative is for at least the innermost portion of the distribution surface 18 (i.e. that facing the passages 26) to be covered with a layer of material resistant to abrasion.

The core 24 includes four divergent passages 38 extending between its rear surface and an annular abutment surface 39 around an axial passage 40 in a front portion of said core. Beyond the front orifices of the passages, the annular abutment surface 39 is extended by a rounded surface 42 merging tangentially with the front face of the core. The core includes a first insert 44 fixed into the front portion of the distributor, to be more specific to the front of the member 32. The annular abutment surface 39 facing the orifices of the divergent passages 38 and the axial passage 40 that extends the annular abutment surface are defined in the insert 44. A cylindrical housing to the rear of the stopper accommodates a second insert 46 containing the four divergent passages.

In the example described, the distributor 22, more specifically the circular member 32, is a force fit inside the hub 13 and the first insert 44 is a force fit inside the front portion of said distributor. The insert 46 is a force fit inside the insert 44. As an alternative to this, the passages 38 could be replaced by splines on the outside surface of the insert 46 or on the inside surface of the housing for said insert. All these members can be made of plastics material or metal. Their functions are as follows.

When the liquid under pressure is introduced into the injector 17, it impinges on the rear face of the core 24 and is deflected in part in the radial direction so that it reaches the back of the distribution surface 18. Due to the effect of centrifugal force, the liquid continues to propagate over this surface, forming a thin film that becomes thinner and thinner as it advances toward the sprayer edge-. When the liquid reaches the sprayer edge, it is sprayed in the form of fine droplets.

A small portion of the liquid enters the divergent passages 38 and impinges on the annular abutment surface 39. This secondary flow of liquid travels round the rounded surface 42 of the axial passage 40 without being sprayed in the forward direction and progresses radially outward over the front surface of the distributor until it rejoins the main flow of liquid flowing along the distribution surface 18. Because of this, the front of the distributor is constantly wetted with the liquid. If the liquid is a paint or a varnish, there is therefore no risk of it drying on the surface of the distributor. Moreover, the sprayer device can easily be cleaned by injecting a cleaning liquid instead of the liquid coating product.

Note that the ratio between the maximum diameter of the distributor 22 and the diameter of the sprayer edge 15 can be from 5% to 60%. The ratio is preferably from 10% to 40%. For devices specifically designed to apply paint electrostatically, the diameter of the sprayer edge is generally from 25 mm to 100 mm.

Variants include replacing the distributor 22 with a radial wall attached to the circular member and incorporating a ring of holes, this arrangement being known to the person skilled in the art.

Of course, the invention also covers any liquid sprayer, in particular any paint or varnish sprayer, which includes a sprayer device as described above. A sprayer of this kind generally comprises a rotational drive system, for example a compressed air turbine, carrying the sprayer device and adapted to inject liquid to be sprayed axially into the interior of the hub. The sprayer is generally completed by a high-voltage electrical power supply for applying a high voltage to the centrifugal deflector 14 (which is conductive, for example made of metal). As previously indicated, the rotation speed can be from 50,000 revolutions per minute to 100,000 revolutions per minute, and the device just described is noteworthy for its capacity to provide a very fine and very regular spray (with a small spread in the size of the droplets), over a wide range of rotation speeds. In particular, it has been found that the spray is still excellent even if the rotation speed is below the range of speeds indicated above. The rotation speed can be reduced to 20,000 revolutions per minute with an acceptable spray. It can also be advantageous to provide means for feeding clean air to the interior of the distributor 22 so that the air exits via the annular passage 30 and/or the passage 40, to reduce the pressure drop at the center of the bell, which could direct partially dried droplets of coating product onto the front face of the distributor.

What is claimed is:

1. A liquid coating product sprayer device comprising:

a tubular hub;

a liquid feed pipe provided in the tubular hub;

a divergent centrifugal deflector adapted to be driven in rotation about a rotation axis and having a sprayer edge and a continuous distribution surface which has the overall shape of a trumpet bell and extends between said hub and said sprayer edge; and means for deflecting at least a portion of said liquid in a substantially radial direction toward an innermost portion of said trumpet bell shaped distribution surface.

2. The sprayer device claimed in claim 1 wherein said distribution surface has a substantially exponential profile in half-section taken along said rotation axis.

3. The sprayer device claimed in claim 1 wherein said distribution surface has the shape of a hyperbolic section in half-section taken along said rotation axis.

4. The sprayer device claimed in claim 1, wherein the means for deflecting include a distributor mounted in axial alignment with said hub, said distributor extends as far as the back of said deflector, and said distributor includes a core forming an obstacle to the axial flow of said liquid and radial passages disposed to the rear of said core to direct at least the greater portion of the liquid flow toward said distribution surface.

5. The sprayer device claimed in claim 4 wherein said core has a circular lateral surface facing and at a distance from said distribution surface to define therewith an annular passage extending from said radial passages.

6. The sprayer device claimed in claim 4 wherein said distributor is force fitted inside said hub.

7. The sprayer device claimed in claim 4 wherein said distributor includes a tubular circular member having a rear mounting portion fixed to the interior of said hub and said radial passages to the rear of said core are formed in said circular member.

8. The sprayer device claimed in claim 4 wherein the ratio between the maximum diameter of said distributor and the diameter of said sprayer edge is from 5% to 60%.

9. The sprayer of claim 8, wherein said ratio is from 10% to 40%.

10. The sprayer device claimed in claim 4 wherein said core has divergent passages extending between a rear surface thereof and an annular abutment surface around an axial passage in a front portion of said core.

11. The sprayer of claim 10, wherein said divergent passage are divergent.

12. The sprayer device claimed in claim 10 wherein said core includes a first insert fixed into said front portion of said distributor and including said annular abutment surface and said axial passage.

13. The sprayer device claimed in claim 12 wherein said first insert is force fitted inside said front portion of said distributor.

14. The sprayer device claimed in claim 12 further including a second insert at the rear of said first insert and containing said divergent passages extending between the rear surface of said core and said annular abutment surface, said passages being divergent.

15. The sprayer device claimed in claim 14 wherein said second insert is force fitted inside said core.

16. The sprayer device claimed in claim 14 wherein said axial passage in a front portion of said core is axial.

17. The sprayer device claimed in claim 1 wherein a central portion of said deflector is lined internally with an annular replaceable wear member integrated with said innermost portion of said distribution surface.

18. The sprayer device claimed in claim 11 wherein the central part of said deflector is provided internally with an annular member whose internal surface at least is made from a material resistant to abrasion.

19. The sprayer device claimed in claim 1 wherein at least the innermost part of said distribution surface is covered with a layer of material resistant to abrasion.

20. The sprayer device claimed in claim 1 wherein said divergent centrifugal deflector is at least partly made from an electrically conductive material and is adapted to be connected to a source of high voltage.

21. A sprayer for spraying a liquid coating product, including a sprayer device as claimed in claim 1.

22. The sprayer of claim 21, wherein the liquid coating product is paint or varnish.

* * * * *